US006948996B2

(12) United States Patent
Tobias, Jr.

(10) Patent No.: US 6,948,996 B2
(45) Date of Patent: Sep. 27, 2005

(54) TOY BUBBLE (S)—IN-BUBBLE GENERATING ASSEMBLY AND METHOD

(76) Inventor: Tomas T. Tobias, Jr., 4 A Boyd Ct., Jersey City, NJ (US) 07304

( * ) Notice: Subject to any disclaimer, the term of this patent is extended or adjusted under 35 U.S.C. 154(b) by 0 days.

(21) Appl. No.: 10/261,239

(22) Filed: Sep. 30, 2002

(65) Prior Publication Data

US 2004/0063377 A1 Apr. 1, 2004

(51) Int. Cl.[7] ..... A63H 33/00
(52) U.S. Cl. ..... 446/15
(58) Field of Search ..... 446/15–21, 267, 446/74

(56) References Cited

U.S. PATENT DOCUMENTS

| | | | | |
|---|---|---|---|---|
| 654,642 | A | | 7/1900 | James |
| 2,041,423 | A | | 5/1936 | Mausolf |
| 2,213,391 | A | | 9/1940 | Gamble |
| 2,527,935 | A | | 10/1950 | Joel, II |
| 3,093,925 | A | | 6/1963 | Greene |
| 3,402,502 | A | | 9/1968 | Kaysen |
| 4,180,938 | A | * | 1/1980 | La Fata et al. ..... 446/15 |
| 4,467,552 | A | * | 8/1984 | Jernigan ..... 446/15 |
| 4,481,731 | A | * | 11/1984 | La Fata et al. ..... 446/45 |
| 5,035,665 | A | * | 7/1991 | Sheng ..... 446/15 |
| 5,462,469 | A | | 10/1995 | Lei |
| 6,102,764 | A | | 8/2000 | Thai |
| 6,139,391 | A | * | 10/2000 | Thai et al. ..... 446/15 |
| 6,331,130 | B1 | * | 12/2001 | Thai ..... 446/15 |
| 6,620,016 | B1 | * | 9/2003 | Thai ..... 446/15 |

* cited by examiner

*Primary Examiner*—Derris H. Banks
*Assistant Examiner*—Faye Francis
(74) *Attorney, Agent, or Firm*—Irwin Ostroff

(57) ABSTRACT

A toy bubble-in-bubble assembly includes first and second hollow tubes, first and second rings, first and second connecting members, and a handle. First ends of the first and second tubes are located on a top portion of the handle. The first tube has a fluted second end which is connected to and separated from a bottom surface of the first ring by the first connecting member. The second connecting member connects the second ring to the handle. The rings are positioned such that planes across each of openings in the rings are essentially perpendicular to each other. The area of the opening in the first ring is smaller than the area of the opening in the second ring. A second end of the second tube is positioned adjacent a top surface of the first ring.

27 Claims, 4 Drawing Sheets

TOY BUBBLE (S)— IN-BUBBLE GENERATING ASSEMBLY AND METHOD

FIELD OF THE INVENTION

The present invention relates to bubble generating apparatus, and more particularly, to toy bubble(s)-in-bubble generating assemblies.

BACKGROUND OF THE INVENTION

A variety of bubble generating toys exists with the simplest perhaps being a stick having a circular member mounted on the top. The circular member is dipped into a bubble solution or bubble producing liquid (e.g., soap) and then removed with a circular opening thereof then being covered with a film of the bubble solution. Blowing air against the film or waving the stick results in the formation of an individual bubble and perhaps several other individual bubbles.

U.S. Pat. No. 2,527,935 (Joel, II) describes a device which is used to generate a bubble within a bubble and includes a handle connected to a parallel combination of two rings with one ring having a smaller diameter than the other. The handle is connected to the larger ring which is connected via a supporting arm to the smaller ring. The two rings are placed in a bubble solution to form films across each. With the smaller ring placed in front of a persons mouth, air is blown across the smaller and larger rings to generate a bubble with a bubble. This device can relatively easily malfunction, and even when generating a bubble within a bubble, the two bubbles can stick together.

U.S. Pat. No. 4,467,552 (Jernigan) describes a bubble blowing toy having two blowing loops connected by a common support member with the loops being disposed in perpendicular planes. The loops produce different types of bubbles. While one loop is being used to produce bubbles, the opposite end loop serves as a handle. One loop is used to generate a bubble within a bubble and the other loop is used to generate two bubbles that share a common side wall. This device can relatively easily malfunction, and even when generating a bubble within a bubble, the two bubbles can stick together.

U.S. Pat. No. 654,642 (James) and U.S. Pat. No. 2,213,391 (Gamble) are examples of bubble generating toys which generate at least one bubble within a bubble. Both use a hollow pipe connected to a circular member which has at least two passages formed there through. Blowing into each of the respective the pipes generates a bubble within a bubble. U.S. Pat. No. 3,402,502 is another example of a bubble generating toy which generates a bubble within a bubble. It uses a fairly complex structure having inner and outer shells and valve. With the value in a first position one blows into a mouthpiece to generate a first bubble. The position of the valve is then changed and then one blows into the mouthpiece to generate a second bubble with surrounds the first bubble. This is a fairly complex device which is relatively expensive to implement.

U.S. Pat. No. 2,041,423 (Mausolf) also uses a hollow pipe connected to a circular member which has three to five passages formed there through to generate three or more bubbles which each share a portion of a common side wall. It does not generate a bubble within a bubble.

U.S. Pat. No. 6,102,764 (Thai) describes a bubble producing assembly which includes a handle, an electrically powered variable speed fan, a primary loop, and a plurality of secondary loops. This assembly is capable of producing a bubble within a bubble or multiple bubbles with a bubble. It is relatively complex and expensive to produce. The turning on of the assembly and subsequent control of the speed of the motor is all that is needed to produce bubbles. Essentially no eye, hand, mouth coordination is required. This limits the amusement value and learning potential for children.

It is desirable to have a bubble generator which generates a bubble within a bubble, is relatively inexpensive to produce, and provides a user with amusement and can improve hand, and mouth coordination.

SUMMARY OF THE INVENTION

From a first apparatus aspect, the present invention is a Bubble-In-Bubble generating assembly. the assembly comprises a bubble generating member having side walls which define a cavity therein and a first opening which is in communication with the cavity, a first ring having side walls which define an opening there through, and first coupling means. The area of the opening in the bubble generating member is smaller than the area of the opening in the second ring. The first ring and the bubble generating member are coupled together. The first ring is adapted to support a film of bubble solution across the opening there through. A plane across the first opening in the bubble generating member is in a non-parallel relation to a plane across the opening in the first ring. The first means couples a first stream of gas into the cavity in the bubble generating member.

From a second apparatus aspect, the present invention is a Bubble-In-Bubble generating assembly which comprises a flexible member having side walls which define a cavity and having a top portion, a hollow conduit, a primary loop member, and a member coupling the primary loop member to the hollow conduit. The hollow conduit has a first end which is coupled to the top portion of the flexible member and has a second end which defines a first opening which is adapted to have a film of bubble solution covering same. Hollow portions of the conduit and the cavity in the flexible member are in communication and are exposed to air when there is no film covering the second end of the conduit. The primary loop member defines a second opening there through and is adapted to have a film of bubble solution covering the second opening. The area of the second opening is greater than the area of the first opening. The member coupling the primary loop member to the hollow conduit with a plane across the first opening being in a non-parallel relation to a plane across the second opening.

From a third apparatus aspect, the present invention is a Bubble-In-Bubble generating assembly which comprises a flexible bulb having side walls which define a cavity and having a top portion, a tubular stick, and a primary loop member, a member connecting the primary loop member to the tubular stick. The tubular stick has a first end which is coupled to the top portion of the flexible member and has a second end which defines a first opening and is adapted to have a film of bubble solution covering same, and interior portions of the tubular stick and the cavity in the flexible member being in communication and being exposed to air when there is no film covering the first opening. The primary loop member defines a second opening there through and being adapted to have a film of bubble solution covering the second opening. The the area of the second opening is greater than the area of the first opening. The member connecting the primary loop member to the tubular stick with a plane across the first opening is essentially perpendicular to a plane across the second opening such that when films of bubble solution are placed over both the openings and the flexible member is compressed, and air is blown across the second openings, a first bubble of a first diameter is generated at the second end of the tubular stick and the first bubble is then blown into the film stretched across the second opening to generate a second bubble having a second diameter which is greater than the first diameter with the first bubble being enclosed within the second bubble.

From a fourth apparatus aspect, the present invention is a Bubble-In-Bubble generating assembly. The assembly comprises a flexible bulb having side walls which define a cavity and having a top portion, a tubular stick having a first end which is coupled to the top portion of the flexible member and having a second end a first ring, a primary loop member, and a connecting member. The first ring has side walls which define a first essentially circular opening through a top serrated portion thereof which is adapted to have a film of bubble solution extend thereacross and cover the first opening. A bottom portion of the first ring is coupled to the second end of the tubular stick. The primary loop member has side walls which define an essentially circular second opening through a top serrated portion thereof which is adapted to have a film of bubble solution extend thereacross and cover the second opening. The diameter of the first essentially circular opening is smaller than the diameter of the second essentially circular opening. The connecting member connects the primary loop member to the tubular stick. A plane across the first opening is essentially perpendicular to a plane across the second opening such that when films of bubble solution are placed over both the openings and the flexible member is compressed to cause a first stream of air to be blown across the first opening, a first bubble of a first diameter is generated at a top of the first ring and this first bubble is then blown by a second stream of air into the film stretched across the second opening in the primary loop member which generates a second bubble having a second diameter which is greater than the first diameter with the first bubble being enclosed within the second bubble.

From a first method aspect the present invention is a method of generating a bubble within a bubble from first and second separated and non-parallel connected rings with an area of an opening defined by the first ring being smaller than an area of an opening defined by the second ring. The method comprises the steps of: forming a film of a bubble solution over each of the openings in the first and second rings; flowing a first stream of gas into the film of bubble solution which covers the opening in the first ring so as to cause a first bubble having a first diameter to be formed; and flowing a second stream of gas into the first bubble and the film which covers the opening in the second ring so as to cause the first bubble to be forced into the film covering the opening in the second ring and to cause a second bubble having a diameter greater than the diameter of the first bubble to be formed with the first bubble being located within the second bubble.

From a second method aspect the present invention is a method of generating a bubble within a bubble from a bubble generating member having side walls which define a cavity therein and a first opening which is in communication with the cavity and a first ring having side walls which define an opening there through with the area of the opening in the bubble generating member being smaller than the area of the opening in the ring and a plane across the first opening in the bubble generating member being in a non-parallel relation to a plane across the opening in the ring. The method comprises the steps of: at least partly filling the cavity in the bubble generating member with a bubble solution; forming a film of a bubble solution over the opening in the ring; flowing a first stream of gas into the bubble generating member to generate at the opening thereof a first bubble having a first diameter; and flowing a second stream of gas at the first bubble and the film covering the opening in the ring so as to cause the first bubble to be forced into the film covering the opening in the ring and to cause a second bubble having a diameter greater than the diameter of the first bubble to be formed with the first bubble being located within the second bubble.

The invention will be better understood from the following more detailed description taken in conjunction with the accompanying drawing and claims.

DETAILED DESCRIPTION

Figure 1:
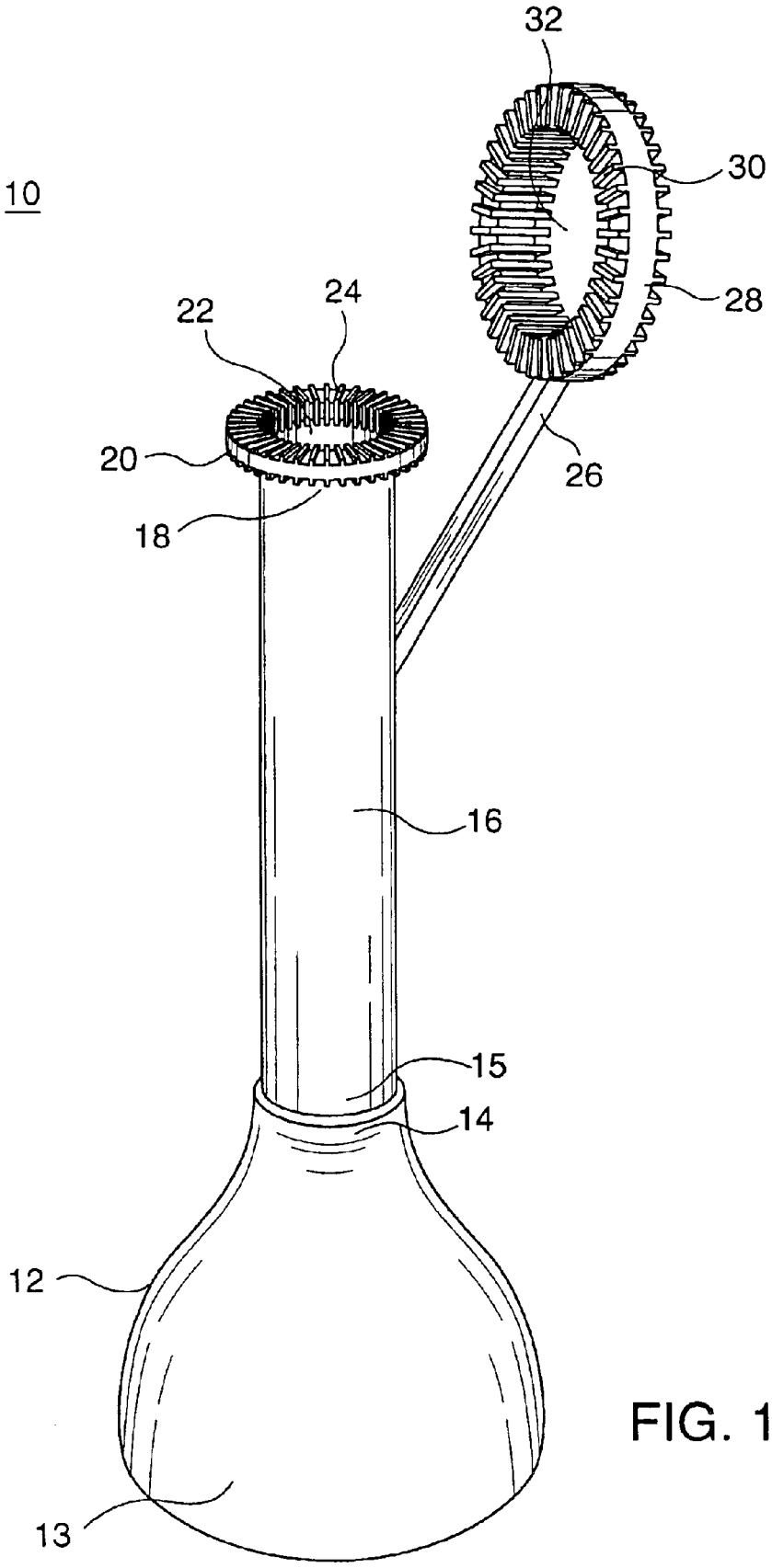
FIG. 1 shows a perspective view of a bubble-in-bubble generator assembly in accordance with one embodiment of the present invention.

Referring now to FIG. 1, there is shown a Bubble-In-Bubble Generating Assembly 10 in accordance with the present invention. Assembly 10 comprises a flexible member (bulb) 12 having walls which define a cavity 13 and a top portion 14, a conduit (tubular stick, hollow tube) 16, a first ring member (secondary loop member, first serrated ring, bubble generating member) 20 having optional ridges 24 and defining an opening (cavity) 22, a coupling (connecting) member 26, and a primary loop member (ring) 28 having optional ridges 30 and defining an opening 32.

A first end 15 of conduit 16 is connected to the top portion 14 of flexible member 12. Ring 20 is connected to a second end 18 of conduit 16 such that an open path exits from ring 20 through opening 22 and hollow conduit 16 to the cavity 13 defined by flexible member 12. Accordingly, air in cavity 13 is expelled through conduit 16 and opening 22 when flexible member 12 is squeezed (compressed).

The squeezing (compressing) of flexible member 12 generates to a first stream of gas (e.g., air) which passes through the opening 22. The coupling member 26 couples (connects) tube 16 to the ring 28 such that a front face of the ring 20 is essentially perpendicular to a front face of the ring 28. The ridges 24 on ring 20 and the ridges 30 on ring 28 are designed to help hold a film of a bubble solution covering each of the rings 20 and 28.

In order to generate a bubble within a bubble, rings 20 and 28 each have a separate film of bubble solution placed across each of the openings 20 and 32. This is easily accomplished by placing rings 20 and 28 in a container of bubble solution (not shown). The flexible member (bulb) 12 is then squeezed to generate a first stream of gas (air) from cavity 13 through hollow conduit 16 and opening 22 in ring 20. This first stream of air impinges on the film of bubble solution (not shown) covering opening 22 and causes a first bubble (not shown) to be generated above opening 22. In a preferred embodiment a person (not shown) then blows a second stream of air which causes the first bubble to be blown towards the opening 32 in ring 30 such that the first bubble and second stream of air impinge on the bubble solution film (not shown) covering the opening 32. This generates a second bubble with the first bubble being contained therein. Accordingly, a bubble-in-bubble is generated by assembly 10.

The first ring member 20 is optional and the top end 18 of the conduit 16 could serve as a first ring member and same would not necessarily need to have ridges but could have bumps, ridges, or ridges and bumps. In one illustrative embodiment the entire assemble 10 is fabricated from plastic. A variety of different materials, including but not limited to metal, wood, rubber, or man made materials could be used to form different parts of assembly 10.

Figure 2:
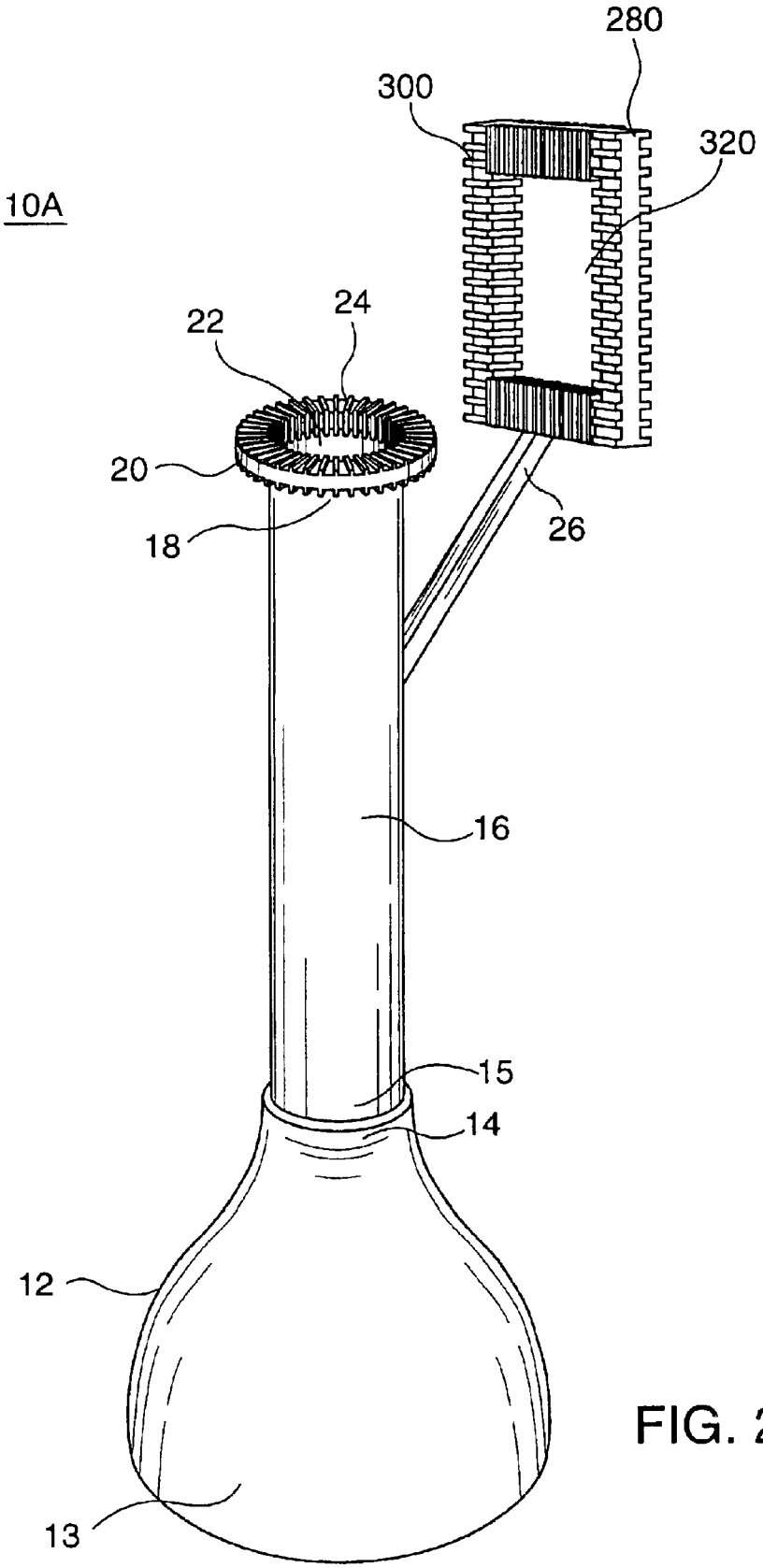
FIG. 2 shows a perspective view of a bubble-in-bubble generator assembly in accordance with an other embodiment of the present invention.

Referring now to FIG. 2, there is shown a Bubble-In-Bubble Generating Assembly 10A in accordance with an other embodiment of the present invention. Assembly 10A is very similar to assembly 10 of FIG. 1 with essentially identical parts of the two shown having the same reference numbers and parts which perform the same function having the same reference number with a "0" thereafter. Assembly 10A has a second ring (primary loop member) 280 that has a rectangular shape and defines a rectangular opening 320 and has optional ridges 300. It also generates a bubble-in-bubble using the same gas (air) flows as assembly 10 of FIG. 1.

Figure 3:
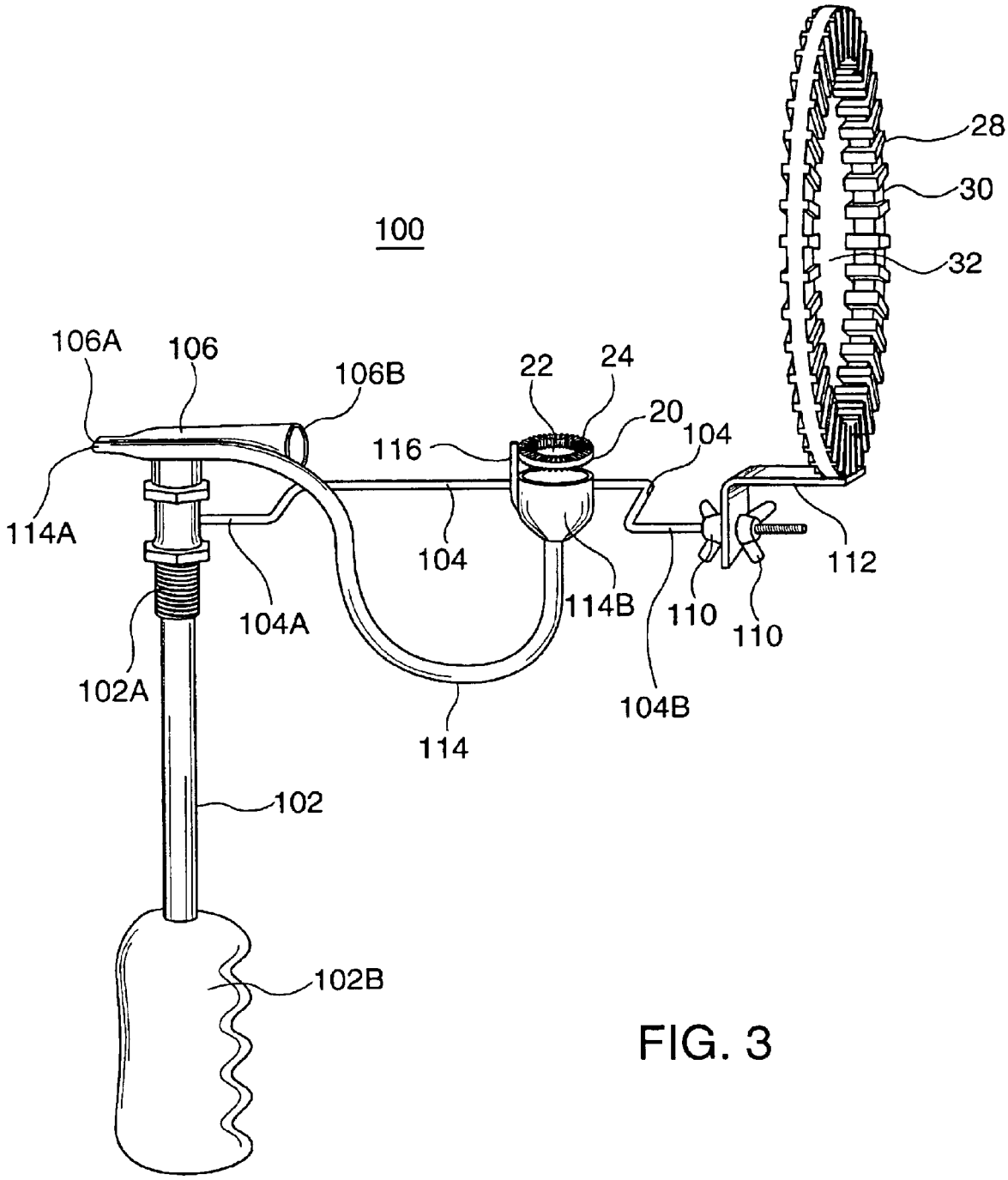
FIG. 3 shows a perspective view of a bubble-in-bubble generator assembly in accordance with still an other embodiment of the present invention.

Referring now to FIG. 3, there is shown a Bubble-In-Bubble Generating Assembly 100 in accordance with a preferred embodiment of the present invention. Assembly 100 comprises a handle 102 having a first end 102A and a second end 102B, a first ring 20 having optional ridges 24 and defining an opening 22 there through, a first connecting member 104 having a first end 104A and a second end 104B, a second ring 28 having optional ridges 30 and defining an opening 32 there through, a first hollow conduit 106 having a first end 106A and a second end 106B, a connector 110 (a pair of wingnuts), and a second hollow conduit 114 having a first end 114A and a second end 114B which is fluted, a second connecting member 116, and a third connecting member 112.

First ends 106A and 114A of conduits 106 and 114, respectively, are positioned on the first end 102A of handle 102 and are optionally touching each other. Ends 106A and 114A can optionally be formed together as a single conduit which forms one arm of a y-shaped member. The fluted second end 114B of conduit 114 is connected through second connecting member 116 to one surface of the ring 20. Connecting member 116 separates second end 114B from ring 20. The second end 106B of the conduit 106 is located adjacent to a second (opposite) surface of ring 20 such that with a gas steam introduced into ends 106A and 114A there are generated streams of gas at ends 106B and 114B which are essentially perpendicular to each other.

Connecting member 104 has a connecting first end portion 104A which is adjustably connected to handle 102 and has a second end 104B which is connected to connector 110 (shown as two wingnuts engaging a threaded portion of connecting member 104. Ring 28 is connected to the connecting member 112 which is connected to the connecting member 104 via connector (wingnuts) 110. The horizontal distance between the opening 24 in ring 20 and the opening 32 in ring 28 can be adjusted by varying the length of the portion of the connecting member 104 between the handle 102 and the connector 110. The vertical position of opening 32 in ring 28 relative to the opening 24 in ring 20 can be varied by moving the second end 104A of connector 104 up or down handle 102. Planes across the opening 24 in ring 20 and the opening 32 in ring 28 are typically essentially perpendicular to each other. Optionally they need not be perpendicular but are not parallel to each other. With films of bubble solution (not shown) across openings 24 and 32 and flows of gas (e.g., air blow from the mouth of a person, or a pump, or a source of compressed gas such as air), a first bubble (not shown) is generated above the opening 24 in ring 20. The first bubble is then blown by the stream of gas exiting conduit 106 at end 106B into the film of bubble solution covering opening 32 in ring 28. This causes a second bubble (not shown) to be generated from the film across the opening 32 with the first bubble being contained therein.

Figure 4:
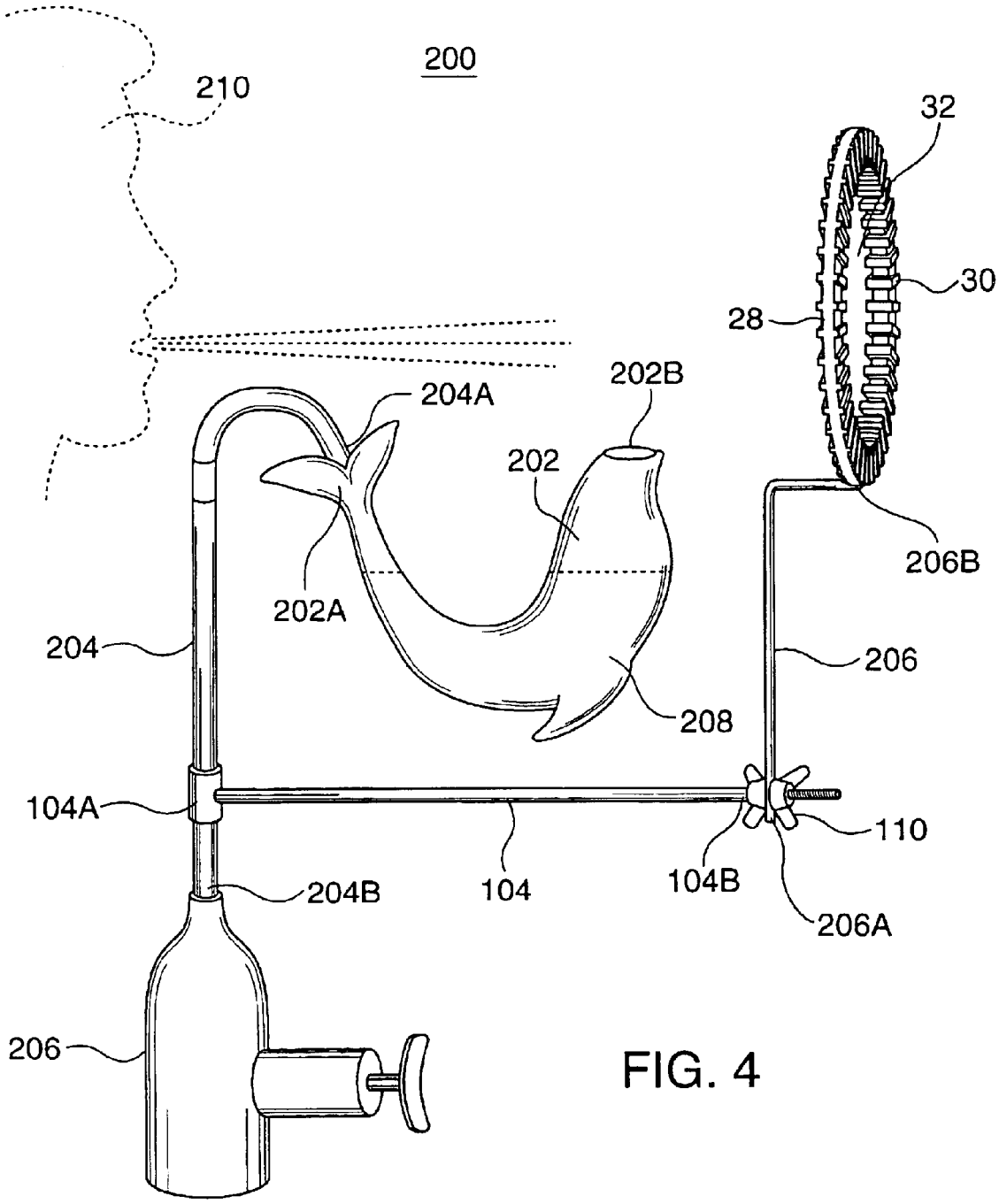
FIG. 4 shows a perspective view of a bubble-in-bubble generator assembly in accordance with still an other embodiment of the present invention.

Referring now to FIG. 4, there is shown a Bubble-In-Bubble Generating Assembly 200 in accordance with an other embodiment of the present invention. Assembly 200 comprises a hollow conduit 204 having a first end 204A and a second end 204B, a source of gas 206 (e.g., a hand held pump), a three dimensional animal figure 202 (e.g., a fish) having an input port 204A and an output (opening) 202B, and having side walls which define a cavity there between which is shown containing a bubble solution 208, a ring 28 having optional ridges 30 and defining an opening 32 there through, a first connecting member 104 having a first end 104A and a second end 104B, a second connecting member 206, and a slideable connector 110.

End 204B of the hollow conduit 204 is connected to an output port of the gas source 206 which is optionally shown as a hand held pump but could be any other gas source such as a container of compressed air or a bulb. Connecting member 104 has a connecting first end portion 104A which is slideable connectable to the conduit 204 and has a second end 104B which is connected to the slideable connector 110. The second connecting member 206 has one end 206A connected to connector 110 and has a second end 206B connected to ring 28. The horizontal distance between the output port (opening) 202B and ring 28 can be adjusted by varying the length of the connecting member 104 between the conduit 204 and the connector 110. The vertical position of ring 28 relative to the output opening 202*b* of animal figure 202 can be varied by moving second end 104A of connector 104 up or down conduit 204. Planes across the opening 202B of animal figure 202 and the opening 32 of ring 28 are typically essentially perpendicular to each other. Optionally they need not be perpendicular but are not parallel to each other.

With the cavity in animal figure 202 at least partly filled with bubble solution 208 and a film of bubble solution (not shown) across opening 32 of ring 28, and flows of gas (e.g., air blow from the mouth of a person 210 and the hand held pump 206), a first bubble (not shown) is generated above the opening 202B in animal figure 202. The first bubble is then blown by the stream of air from a persons mouth into the film of bubble solution covering opening 32 in ring 28. This causes a second bubble (not shown) to be generated from the film across the opening 32 with the first bubble being contained therein.

It is to be understood that the specific embodiments described are merely illustrative of the general principles of the invention and that, accordingly, other embodiments may be devised by a skilled worker in the art without departing from the spirit and scope of the invention. For example, the shape of each of the rings 20 (secondary loop member) and 28 (primary loop member) can be other than circular such square, rectangular, triangular, or other geometric shapes so long as the opening in the secondary loop member (ring) is smaller than in the primary loop member (ring). Still further, a second flexible member and conduit coupled together, as are flexible member 12 and conduit 16 of FIGS. 1 and 2, can be connected via an other coupling (connecting) member to the top of conduit 16 such that as a first bubble is generated by squeezing flexible member 12, the second flexible member is squeezed so as to blow the first bubble into the bubble solution film across opening 32 so as to generate a second bubble with the first bubble contained therein. Still further, the conduits 16 of FIGS. 1 and 2 can have fluted ends, such as fluted end 114B as conduit 114 of FIG. 3, and each can have a connecting member 116 which connects and separates rings 20 from conduit 16. Furthermore, the animal figure 202 of FIG. 4 can be substituted for the fluted end 114B of conduit 114, the connecting member 116, and the ring 20 of assembly 100 of FIG. 3.

What is claimed is:

1. Bubble-In-Bubble generating assembly comprising:

a bubble generator having side walls which define a cavity therein and a first opening which is in communication with the cavity;

a first ring having side walls which define an opening there through; the area of the opening in the bubble generator being smaller than the area of the opening in the first ring;

the first ring and the bubble generator being coupled together;

a plane across the first opening in the bubble generator being in a non-parallel relation to a plane across the opening in the first ring;

first means for coupling a first stream of gas into the cavity in the bubble generator; and the openings in the first bubble generator and the first ring being adjacent and positioned relative to each other such that a bubble generated at the opening in the first bubble generator is adjacent the opening in the first ring thus enabling the bubble to be blown into the opening in the first ring to generate a bubble within a bubble.

2. The assembly of claim 1 wherein:

the side walls of the bubble generator define a second opening which is in communication with the cavity in the bubble generator;

the first means is coupled to the second opening in the bubble generator; and the cavity in the bubble generator being adapted to hold bubble solution such that with a first stream of gas flowing through the first coupling means into the cavity in the bubble generator and the cavity containing bubble solution, at least one bubble is generated which exits the bubble generator via the first opening thereof.

3. The assembly of claim 1 further comprising a second means for coupling a second stream of gas essentially parallel to the plane of the first opening in bubble generator such that a bubble exiting at the first opening of the bubble generator is blown towards one side of the opening in the first ring, and with a film of bubble solution covering the opening in the first ring, there is generated on the opposite side of the opening in the first ring a second bubble with the first bubble being contained therein.

4. The assembly of claim 1 wherein the bubble generator is in the shape of an animal.

5. The assembly of claim 1 wherein:

the bubble generator comprises a second ring having an opening there through;

the first ring being adapted to support a film of bubble solution covering a first surface of said opening there through; and the second ring being adapted to support a film of bubble solution covering a first surface of said opening there through.

6. The assembly of claim 3 wherein the first and second means are first and second hollow conduits.

7. The assembly of claim 5 wherein first ends of the first and second conduits are coupled together.

8. Bubble-In-Bubble generating assembly comprising:

a flexible member having side walls which define a cavity and having a top portion;

a hollow conduit having a first end which is coupled to the top portion of the flexible member and having a second end which defines a first opening which is adapted to have a film of bubble solution covering same, hollow portions of the conduit and the cavity in the flexible member being in communication and being exposed to air when there is no film covering the second end of the conduit;

a primary loop member defining a second opening there through and being adapted to have a film of bubble solution covering the second opening, the area of the second opening being greater than the area of the first opening; and a member coupling the primary loop member to the hollow conduit with a plane across the first opening being in a non-parallel relation to a plane across the second opening.

9. The assembly of claim 8 wherein the first and second openings are both circular.

10. The assembly of claim 8 wherein the flexible member is in the shape of a bulb.

11. The assembly of claim 8 wherein all portions thereof are plastic.

12. The assembly of claim 8 further comprising:

a secondary loop member which defines a third opening there through;

the secondary loop member being coupled to the second end of the hollow conduit;

the third opening in the secondary loop member being smaller than the second opening in the primary loop member; and the secondary loop member having ridges.

13. The assembly of claim 8 further comprising:

the first hollow conduit has a fluted end;

a connector which connects the fluted end to a ring and separates the fluted end from the ring; and the ring being adapted to have a film of bubbler solution covering a third opening defined by side walls thereof, and the area of the third opening being greater than the area of the first opening; and a plane across the third opening being in a non-parallel relation to a plane across the second opening.

14. Bubble-In-Bubble generating assembly comprising:

a flexible bulb having side walls which define a cavity and having a top portion;

a tubular stick having a first end which is coupled to the top portion of the flexible member and having a second end which defines a first opening and is adapted to have a film of bubble solution covering same, and interior portions of the tubular stick and the cavity in the flexible member being in communication and being exposed to air when there is no film covering the first opening;

a primary loop member defining a second opening there through and being adapted to have a film of bubble solution covering the second opening, the area of the second opening being greater than the area of the first opening;

a member connecting the primary loop member to the tubular stick with a plane across the first opening being essentially perpendicular to a plane across the second opening such that when films of bubble solution are placed over both the openings and the flexible member is compressed, and air is blown across the second openings, a first bubble of a first diameter is generated at the second end of the tubular stick and the first bubble is then blown into the film stretched across the second opening to generate a second bubble having a second diameter which is greater than the first diameter with the first bubble being enclosed within the second bubble.

15. The assembly of claim 14 wherein the first and second openings are both circular.

16. The assembly of claim 14 wherein the flexible member is in the shape of a bulb.

17. The assembly of claim 14 wherein all portions thereof are plastic.

18. The assembly of claim 14 further comprising:

a secondary loop member which defines a third opening there through;

the secondary loop member being coupled to the second end of the tubular stick;

the third opening in the secondary loop member being smaller than the second opening in the primary loop member; and the secondary loop member having ridges.

19. The assembly of claim 14 further comprising:

the tubular stick has a fluted end;

a connector which connects the fluted end to a ring and separates the fluted end from the ring; and the ring being adapted to have a film of bubble solution covering a third opening defined by side walls thereof, and the area of the third opening being greater than the area of the first opening; and a plane across the third opening being in a non-parallel relation to a plane across the second opening.

20. Bubble-In-Bubble generating assembly comprising:

a flexible bulb having side walls which define a cavity and having a top portion;

a tubular stick having a first end which is coupled to the top portion of the flexible member and having a second end;

a first ring having side walls which define a first essentially circular opening through a top serrated portion thereof which is adapted to have a film of bubble solution extend there across and cover the first opening, a bottom portion of the first ring being coupled to the second end of the tubular stick;

a primary loop member having side walls which define an essentially circular second opening through a top serrated portion thereof which is adapted to have a film of bubble solution extend there across and cover the second opening;

the diameter of the first essentially circular opening being smaller than the diameter of the second essentially circular opening; and a member connecting the primary loop member to the tubular stick with a plane across the first opening being essentially perpendicular to a plane across the second opening such that when films of bubble solution are placed over both the openings and the flexible member is compressed to cause a first stream of air to be blown across the first opening, a first bubble of a first diameter is generated at a top of the first ring and this first bubble is then blown by a second stream of air into the film stretched across the second opening in the primary loop member which generates a second bubble having a second diameter which is greater than the first diameter with the first bubble being enclosed within the second bubble.

21. The assembly of claim 20 wherein the first and second openings are both circular.

22. The assembly of claim 20 wherein all portions thereof are plastic.

23. The assembly of claim 20 further comprising:

the tubular stick has a fluted end; and a connector connects the fluted end of the tubular stick to the first ring and separates the fluted end from the first ring.

24. A method of generating a bubble within a bubble from first and second separated and non-parallel connected rings with an area of an opening defined by the first ring being smaller than an area of an opening defined by the second ring and a plane across the opening in the first ring being in a non-parallel relation to a plane across the opening in the second ring, said method comprising the steps of:

forming a film of a bubble solution over each of the openings in the first and second rings;

flowing a first stream of gas into the film of bubble solution which covers the opening in the first ring so as to cause a first bubble having a first diameter to be formed; and flowing a second stream of gas into the first bubble and the film which covers the opening in the second ring so as to cause the first bubble to be forced into the film covering the opening in the second ring and to cause a second bubble having a diameter greater than the diameter of the first bubble to be formed with the first bubble being located within the second bubble.

25. A method of generating a bubble within a bubble from a bubble generator having side walls which define a cavity therein and a first opening which is in communication with the cavity and a first ring having side walls which define an opening there through with the area of the opening in the bubble generator being smaller than the area of the opening in the ring and a plane across the first opening in the bubble generator being in a non-parallel relation to a plane across the opening in the ring, the method comprising the steps of:

at least partly filling the cavity in the bubble generator with a bubble solution;

forming a film of a bubble solution over the opening in the ring;

flowing a first stream of gas into the bubble generator to generate at the opening thereof a first bubble having a first diameter; and flowing a second stream of gas at the first bubble and the film covering the opening in the ring so as to cause the first bubble to be forced into the film covering the opening in the ring and to cause a second bubble having a diameter greater than the diameter of the first bubble to be formed with the first bubble being located within the second bubble.

26. Bubble-In-Bubble generating assembly comprising:

a first bubble generator defining an a-first opening therein;

a second bubble generator defining an a-first opening therein;

the first opening in the first bubble generator being smaller than the first opening in the second bubble generator;

the first and second bubble generators being coupled together;

a plane across the first opening in the first bubble generator being in a non-parallel relation to a plane across the first opening in the second bubble generator; and the openings in the first and second bubble generators being adjacent and positioned relative to each other such that a bubble generated at the opening in the first bubble generator is adjacent the opening in the second bubble generator thus enabling the generated bubble to be blown into the opening in the second bubble generator to generate a bubble within a bubble.

27. A method of generating a bubble in a bubble using first and second bubble generators that are coupled together with each defining an opening therein and with the opening in the first bubble generator member being smaller than the opening in the second bubble generator, and with a plane across the first opening in the first bubble generator in a non-parallel relation to a plane across the first opening in the second bubble generator, said method comprising the steps of:

generating, using a first stream of gas, a first bubble from the first bubble generator which exits the first bubble generator at the first opening therein; and flowing a second stream of gas at the first bubble such that the first bubble is blown into the opening in the second bubble generator and results in a second bubble being generated by the second bubble generator that encloses the first bubble.

* * * * *